US005513771A

United States Patent [19]

Cote

[11] Patent Number: 5,513,771

[45] Date of Patent: May 7, 1996

[54] SHAVING DISPENSER

[76] Inventor: Gerald Cote, 35 Eastbourne Ave., Hamilton, Ontario, Canada, L8M 2M6

[21] Appl. No.: 305,287

[22] Filed: Sep. 14, 1994

[51] Int. Cl.[6] ..... G07F 11/36

[52] U.S. Cl. ..... 221/75; 221/96; 221/102; 221/150 A; 221/199; 222/146.5

[58] Field of Search ..... 221/75, 96, 97, 221/102, 150 A, 199; 222/146.5, 192, 399

[56] References Cited

U.S. PATENT DOCUMENTS

| | | | |
|---|---|---|---|
| 1,915,522 | 6/1933 | Eriksen | 221/102 X |
| 2,965,427 | 12/1960 | Sessions | 221/102 X |
| 3,198,389 | 8/1965 | Dunning | 221/96 X |
| 3,335,910 | 8/1967 | Rossi | 222/192 X |
| 3,434,629 | 3/1969 | Hooge et al. | 221/96 X |
| 3,580,863 | 5/1971 | Campbell | 222/146.5 X |
| 3,990,612 | 11/1976 | Gasser | 222/146.5 |
| 4,625,402 | 12/1986 | Kavoussi | 221/192 X |
| 5,064,092 | 11/1991 | Grossi | 221/75 |

*Primary Examiner*—William E. Terrell
*Assistant Examiner*—Dean A. Reichard
*Attorney, Agent, or Firm*—Eugene J. A. Gierczak

[57] ABSTRACT

A dispenser for razors having a housing, a helical coil for stacking and dispensing the packages of razors, coin activating means for activating the helical coil for dispensing one package from said housing, a shaving cream canister for containing shaving cream, a heating coil for heating a portion of said shaving cream, carbon dioxide pressurized canister for pushing the heated shaving cream, and a spigot for releasing the heated shaving cream from the heating coil.

13 Claims, 2 Drawing Sheets

SHAVING DISPENSER

FIELD OF INVENTION

This invention relates to a shaving centre and particularly relates to a dispenser for dispensing packages of razors and wet towel and heated shaving cream.

BACKGROUND OF THE INVENTION

Various vending machines have heretofore been designed to dispense food, beverage and novelty items. Such vending machines are generally activated by the insertion of coins and either dispense food items at room temperature or heat beverages such as coffee or the like.

Other apparatus, for example, as shown in the U.S. Pat. No. 1,367,033 relate to apparatus for the removal of a towel from its compartment into position accessible to the intended user as well as including means for preventing the withdrawal of more than one towel at a time.

Other arrangements are shown in U.S. Pat. No. 5,134,957 which relates to a dispenser for containing and dispensing samples of cosmetic product delivered by a roll of paper emerging from the dispenser in a predetermined sequence.

Moreover, U.S. Pat. No. 4,694,973 relates to a dispenser for disposing pre-wetted towels in prepackaged and plastic canisters.

Yet another arrangement is shown in U.S. Pat. No. 4,978,031 which relates to a dispenser system for razor blade units which includes a dispenser housing in which the razor blade units are successively and displaceably disposed.

These and other razor blade or packaged dispensers have relatively limited utility which do not disclose portable vending machines which are safe and sanitary for the disposal of packages of razors and wetted towels as well as heated shaving cream which may be utilized in high traffic areas such as airports or the like.

It is an object of this invention to provide an improved dispenser for shaving packages.

The broadest aspect of this invention relates to a dispenser for razor packages which includes a housing for housing razor packages, activating structure for activating the dispensing of the razor packages from the housing, a canister for containing shaving cream, a heating coil for heating a portion of the shaving cream from the canister, a pressurized structure for pushing the heated shaving cream from the heating coil, and displaceable structure for releasing the heated shaving cream from the heated coil.

Another aspect of this invention relates to a dispenser for razors which includes a housing, a helical coil for stacking and dispensing packages of razors, a coin activated structure for activating the helical coil to dispense one package from the housing, a shaving cream canister for containing shaving cream, a heating coil for heating a portion of said shaving cream received from said shaving cream canister, carbon dioxide pressurized canister for pushing the heated shaving cream from the heated coil, and a spigot for releasing the heated shaving cream from the heating coil.

DESCRIPTION OF THE DRAWINGS

These and other objects and features of the invention shall now be described in relation to the following drawings.

DESCRIPTION OF THE INVENTION

Like parts shall be given like numbers throughout the figures.

Figure 1:
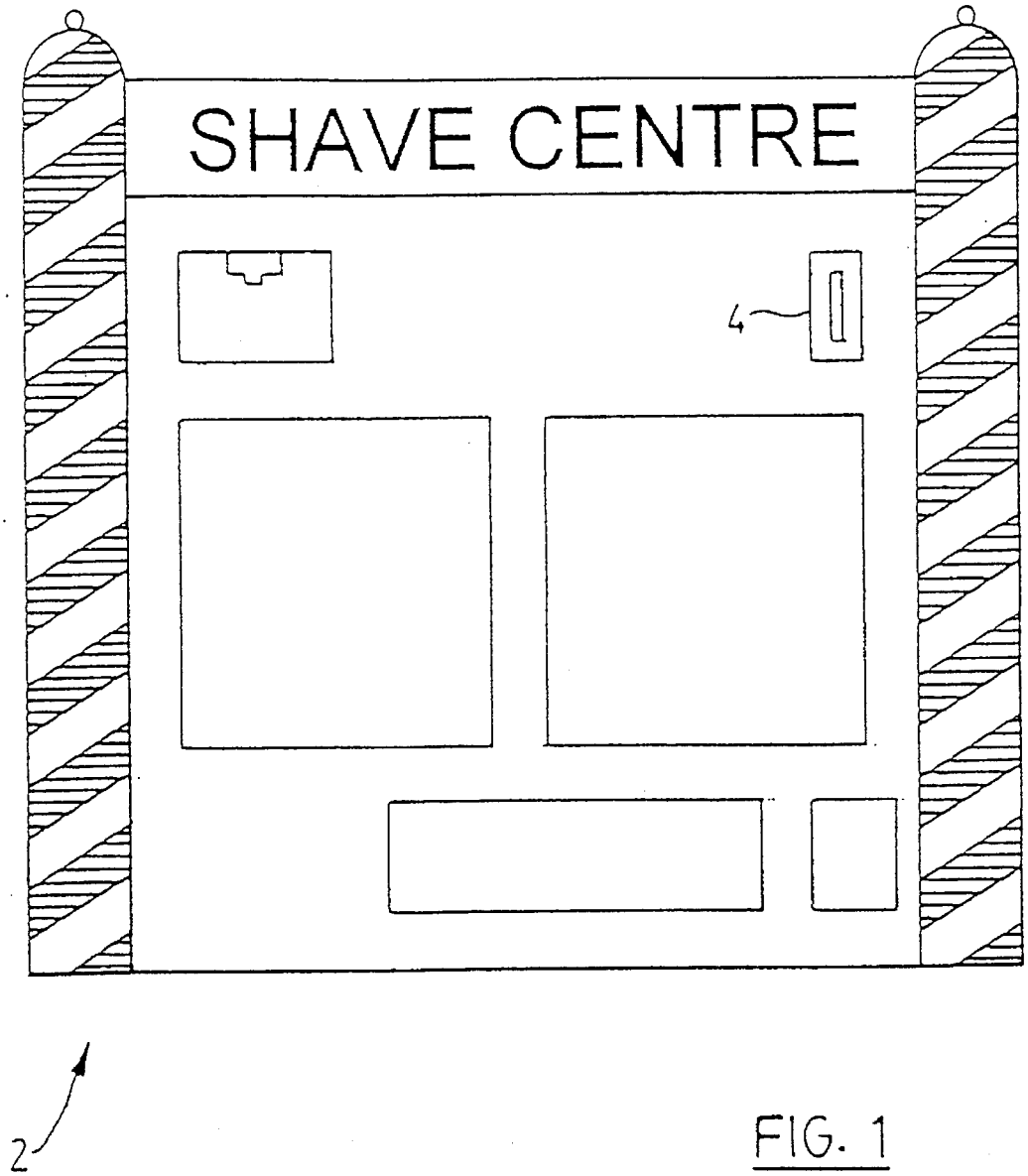
FIG. 1 is a front elevational view of said shaving centre.

FIG. 1 shows one embodiment of the front elevational view of the shaving centre or dispenser 2 which generally comprises a vending machine having a coin slot or coin activating means 4 which is a adapted to receive a predetermined number of coins or tokens.

Once the coin activating means 4 receive the appropriate number of coins such coins slide through passage way 6 to a coin recognizing station 8 which stores the appropriate coins by means of passage 10 into coin storage area 12. Any change will be routed through change slot 14.

The dispenser 2 includes a housing 16 which is made of metal or plastic and includes front and back panels 18 and 20 top and bottom panels 22 and 24 as well as side panels 26 and 28, respectively. The housing 16 contains the coin receiving means 4 as well as stacking means 30 and 32. In particular the stacking means 32 comprise a variety of stacking means such as that shown in FIG. 2 which includes a helical coil 34 which is adapted to receive a plurality of packages 36 within the coil so as to present stacked packages. Such packages generally include a razor and wet towels within one package which is wrapped in cellophane or alternatively may include one package which includes a razor in stacked means 30 with a separate package having a wet towels in stacking means 32. In other words the dispenser may be adapted so that upon insertion of the appropriate coins into coin activating means 4 appropriate electrical signal is sent by coin recognizing station 8 through wire 38 to circuit means 40 which then activates motors 42 by means of wires 44 and 46, respectively.

In one embodiment of the invention stacking means 30 and 32 each contain the same packages, namely a package containing a razor and a wet towel. Stacking means 30 may first be depleted so as to dispense the appropriate packages through slot 48. Once stacking means 30 is depleted appropriate signal will be sent by means of wire 46 to stacking means 32 so as to continue to dispense the appropriate packages.

In another embodiment stacking means 30 may include packages of razors only while stacking means 32 includes packages of wet towels only and then depending on the appropriate coins that are inserted the different packages may be dispensed through slot 48 depending on the appropriate levers which are pulled.

Moreover once circuit means 40 recognizes that the appropriate coins have been inserted through coin slot 4 appropriate signal may be sent by means of wire 50 to a heating electrical circuit 52 which is utilized to heat the shaving cream in a manner to be described herein.

Within the confines of the housing 16 are placed a canister containing shaving cream 54 as well as a pressurized canister of carbon dioxide 56. The shaving cream canister 54 includes a outlet 56 which is connected to a coil 58. The heating coil 58 is hollow so as to permit the introduction of an appropriate measured amount of shaving cream. Heating coils 60 are disposed exteriorally of the coil 58 and are electrically connected to the heating circuit 52. Accordingly, once the heating circuit 52 is activated by electrical circuit 40 a measured amount of shaving cream is introduced into the heating coil 58 and heated by the coil 60. The shaving cream will exit canister 54 through outlet 56 into the coil 58. Once the temperature of the shaving cream reaches a preselected level appropriate temperature gauges 62 read the temperature and activate the valve 64 so as to permit the introduction of pressurized carbon dioxide gas from canister 56 by means of conduits 66. Moreover heating circuit 52 by means of temperature gauge 62 activates a signal light 70 which signals to the user that the shaving cream has reached a preselected temperature and may be released through spigot 72. Upon depressing or displacing spigot 72 downwardly a preselected amount of heated shaving cream travels through coil 58 through exit conduit 74 onto the user's hand.

Figure 2:
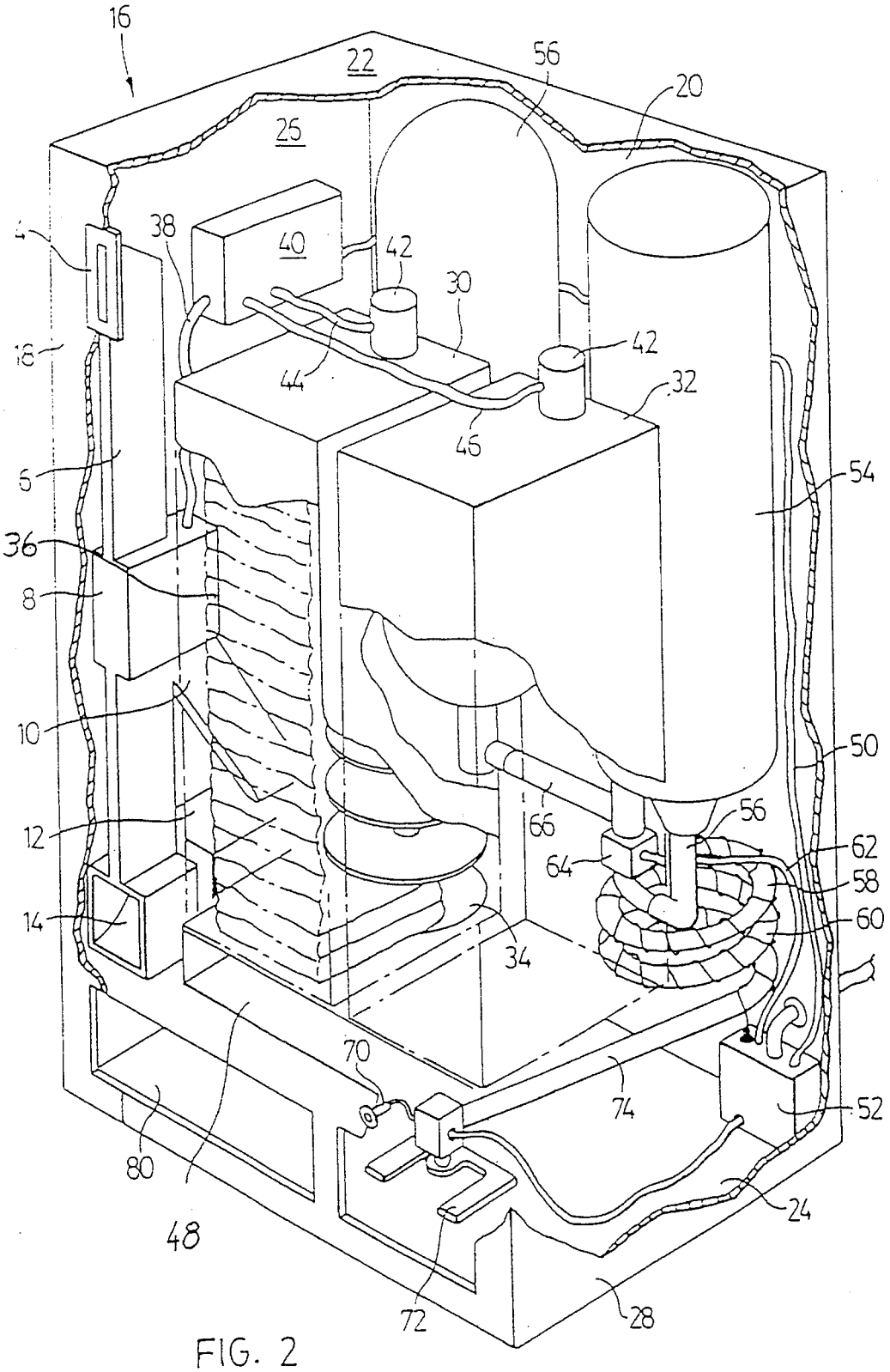
FIG. 2 is a perspective view of said dispenser.

Accordingly the use of the dispenser or vending machine shall now be described in relation to FIG. 2. Upon insertion of the appropriate coins into coin receiving means 4 appropriate signals are dispatched through structure 8 into electrical circuit 40 activating the coils 34 so as to dispense one package through slot as shown in FIG. 2. The user will open the package to remove the razor. In the mean time the appropriate signal is dispatched from electrical circuit 40 to heating circuit 52 which activates the heating coil so as to heat the shaving cream. Upon reaching a preselected temperature signal 70 is activated and the user will press spigot 72 to obtain a preselected level of heated shaving cream. The user will then shave and use the wet towel for clean up purposes. The used razor and wet towel may be thrown out into receptacle 80. Moreover the dispenser 2 may include a mirror so as to assist the user therein.

Although the dispenser 2 has been described in relation to electronic circuitry mechanical levers may also be utilized. Moreover, shaving gel may be used rather than shaving cream. Furthermore compressed air may be utilized in place of the carbon dioxide.

Although the preferred embodiment as well as the operation and the use have been specifically described in relation to the drawings, it should be understood that variations in the preferred embodiments could be achieved by a person skilled in the trade without departing from the spirit of the invention as claimed herein.

The embodiments of the invention in which an exclusive property or privilege is claimed are defined as follows:

1. A vending machine for vending a razor, and for vending shaving cream, said vending machine comprising:

coin activation means for receiving coins and activating said vending machine;

a razor dispenser; and a shaving cream dispenser;

said razor and shaving cream dispensers responsive to said coin activation means;

said shaving cream dispenser comprising a canister for containing shaving cream, metering means for measuring an amount of shaving cream to be dispensed, and heating means for heating that amount of shaving cream to be dispensed;

whereby reception of coins in said coin activation means activates said razor dispenser to dispense a razor and activates said shaving cream dispenser to meter and heat a selected amount of shaving cream.

2. The vending machine of claim 1 wherein:

said vending machine comprises housing means and a helical coil for holding said razors in a stack within said housing; and said shaving cream dispenser comprises a pressurized means for pushing said heated shaving cream from said heating means and displaceable means for releasing said heated shaving cream from said heating means;

whereby displacement of said displaceable means permits said pressurized means to push said shaving cream and to release said shaving cream from said heating means.

3. The vending machine of claim 2 wherein:

said shaving cream dispenser comprises a temperature sensor for sensing the temperature of said shaving cream in said heating means and a signal light responsive to said temperature sensor for signalling when said shaving cream is heated for use.

4. A dispenser for razor packages and shaving cream, said dispenser including:

a housing for a razor dispenser; said razor dispenser within said housing, said razor dispenser comprising a helical coil for stacking said razor packages and for dispensing said razor packages one package at a time; and coin activated means for dispensing said razor packages;

a first canister for containing shaving cream;

said first canister having an outlet connected to a hollow heating coil; said heating coil for containing and for heating a measured amount of shaving cream received from said first canister;

said heating coil having an outlet and a displaceable means controlling said outlet;

a second pressurized gas canister and a conduit connecting said second canister to said first canister and said heating coil, said second canister containing gas for pushing shaving cream from said heating coil.

5. A dispenser as claimed in claim 4 wherein said heating coil has heating elements disposed externally thereabout.

6. A dispenser as claimed in claim 5 wherein said displaceable means comprises a spigot for releasing said shaving cream from said heating coil.

7. A dispenser as claimed in claim 6 further comprising a temperature monitoring means for monitoring the temperature of shaving cream in said heating coil.

8. A dispenser as claimed in claim 7 comprising a valve for releasing gas from said second canister, and wherein said gas is carbon dioxide.

9. A dispenser as claimed in claim 8 including signal means for signalling to a user that shaving cream in said coil has reached a predetermined temperature.

10. A dispenser as claimed in claim 9 wherein said razor package includes a razor and a wet towel.

11. A dispenser as claimed in claim 9 wherein said razor package includes a first package containing a razor and a second package containing a wet towel.

12. A dispenser as claimed in claim 11 further comprising a waste receptacle.

13. A dispenser for razors comprising:

(a) a housing;

(b) a helical coil for stacking and dispensing packages of said razors;

(c) coil activating means for activating said helical coil for dispensing one package from said housing;

(d) a canister for containing shaving cream;

(e) a heating coil for heating an amount of said shaving cream received from said shaving cream canister;

(f) carbon dioxide pressurized means for pushing said heated shaving cream from said heating coil;

(g) a spigot for releasing said heated shaving cream from said heating coil.

* * * * *